US007402985B2

(12) United States Patent
Zlatkovic

(10) Patent No.: US 7,402,985 B2
(45) Date of Patent: Jul. 22, 2008

(54) DUAL PATH LINEAR VOLTAGE REGULATOR

(75) Inventor: Vladimir Zlatkovic, Belmont, MA (US)

(73) Assignee: Intel Corporation, Santa Clara, CA (US)

( * ) Notice: Subject to any disclaimer, the term of this patent is extended or adjusted under 35 U.S.C. 154(b) by 57 days.

(21) Appl. No.: 11/516,214

(22) Filed: Sep. 6, 2006

(65) Prior Publication Data

US 2008/0054861 A1 Mar. 6, 2008

(51) Int. Cl.
*G05F 1/565* (2006.01)
*G05F 1/575* (2006.01)

(52) U.S. Cl. ..... 323/275; 323/270; 323/274

(58) Field of Classification Search ..... 323/269, 323/270, 273, 274, 275, 280, 281
See application file for complete search history.

(56) References Cited

U.S. PATENT DOCUMENTS 5,552,697 A * 9/1996 Chan ..... 323/282
5,608,312 A * 3/1997 Wallace ..... 323/224
7,126,317 B2 * 10/2006 Schreck ..... 323/282

* cited by examiner

*Primary Examiner*—Gary L Laxton
(74) *Attorney, Agent, or Firm*—Seth Z. Kalson

(57) ABSTRACT

A voltage regulator comprising two feedback loops for regulating a load voltage, where the first feedback loop comprises a pass transistor to source current to the load, and the second feedback loop comprises a shunt transistor to shunt current from the pass transistor to ground. The use of two feedback loops allows the design of a voltage regulator in which it small-signal impedance, as seen by a power rail, has a phase not less than −90 degrees. This mitigates interactions between the power rail and the voltage regulator that may lead to oscillations, without the need for a relatively large de-coupling capacitor. Other embodiments are described and claimed.

17 Claims, 3 Drawing Sheets

$\angle Z_{REG}$

DUAL PATH LINEAR VOLTAGE REGULATOR

FIELD

Embodiments of the present invention relate to electronic circuits, and more particularly, to voltage regulators.

BACKGROUND

A large class of linear voltage regulators provides a regulated voltage by way of a feedback loop comprising an operational amplifier and a pass transistor. An example of a linear voltage regulator is illustrated in FIG. 2. As is well known, a negative feedback loop regulates the voltage at node 202 to match a reference voltage $V_{REF}$, where the feedback loop is formed by the output port of amplifier A connected to the gate of pass transistor Q, and the drain of transistor Q connected to the positive input port of amplifier A. The reference voltage $V_{REF}$ is applied at the negative input port to amplifier A. Load 204 is the circuit for which a regulated voltage is desired, and capacitor 204 is a de-coupling capacitor. Load 204 may be, for example, a circuit within a microprocessor. Particular examples include, but are not limited to, a phase locked loop, a delay locked loop, or a thermal sensor.

Let $Z_{REG}$ denote the small-signal impedance presented by the linear voltage regulator to voltage rail 204. It has been observed that there may be an undesirable interaction between the supply voltage Vcc at voltage rail 204 and the linear voltage regulator of FIG. 2. In particular, it has been observed that if the phase of the impedance $Z_{REG}$ falls below −90 degrees, there may be spontaneous oscillations at voltage rail 204. This problem is more likely to worsen as the number of linear voltage regulators connected to voltage rail 204 increases, as for example in applications in which there are more than one microprocessor core or more than one I/O (Input/Output) channel.

A linear voltage regulator of the type illustrated in FIG. 2 is generally designed so that the poles of its closed-loop transfer function are the zeros of its impedance $Z_{REG}$. This results in the phase of the impedance $Z_{REG}$ being less than −90 degrees, unless the linear voltage regulator is designed to be over-damped. However, such an over-damped design is not necessarily trivial or desirable for some applications, as it generally requires a relatively large capacitor for compensation. Furthermore, such a relatively large capacitor results in a linear voltage regulator with a low operating bandwidth. A low operating bandwidth linear voltage regulator may need a large output de-coupling capacitor to provide adequate power supply rejection (PSR). But large output de-coupling capacitors are not necessarily desirable because of their size, and because of possible current leakage.

DESCRIPTION OF EMBODIMENTS

Figure 1:
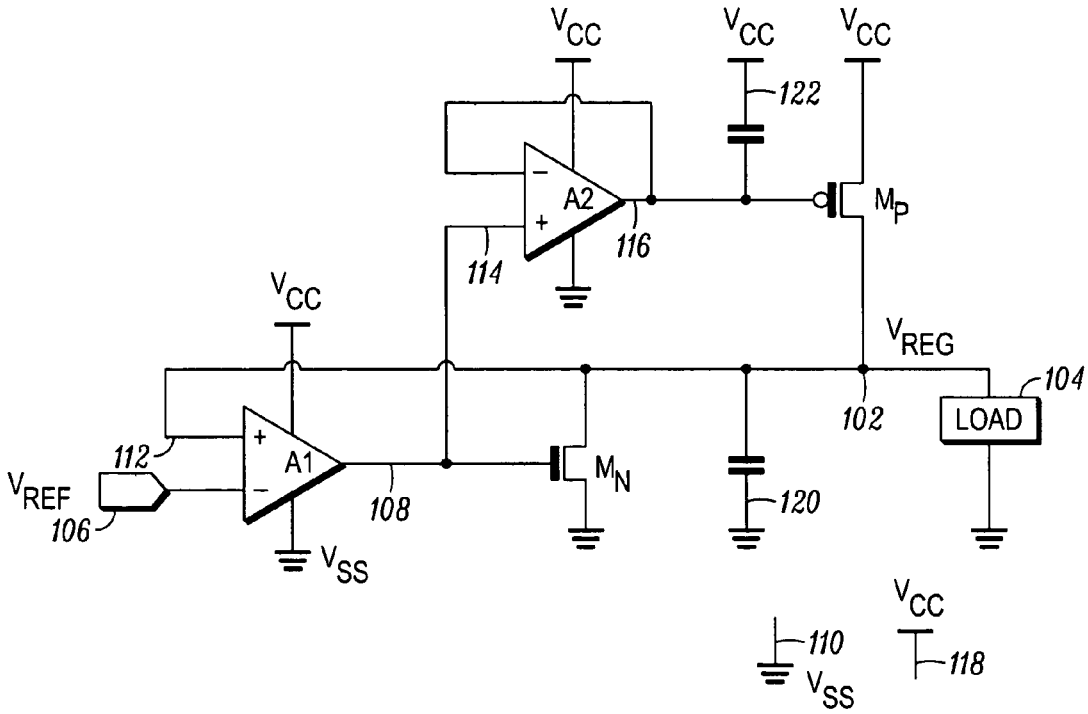
FIG. 1 illustrates an embodiment of the present invention.
Figure 2:
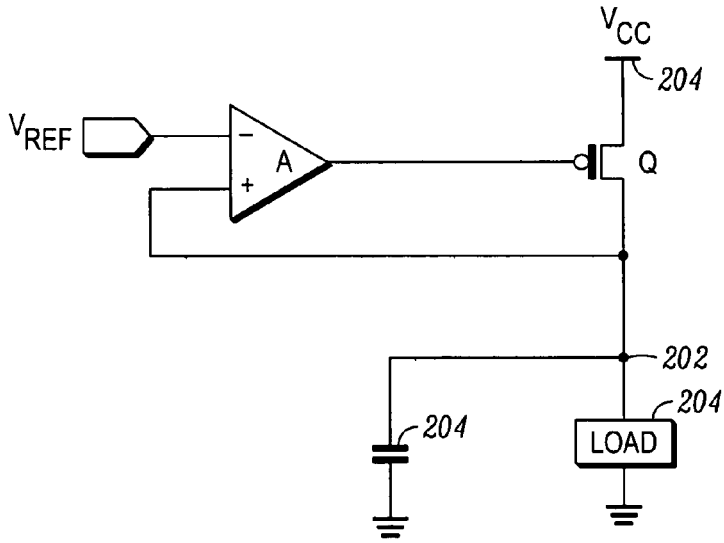
(PRIOR ART) FIG. 2
FIG. 2 is a prior art linear voltage regulator.

FIG. 1 illustrates an embodiment of the present invention, which may be termed a dual path linear voltage regulator. A regulated voltage $V_{REG}$ at node 102 is provided to load 104. Load 104 may comprise a circuit, such as for example an analog circuit in which a well-regulated voltage is desired. In the embodiment of FIG. 1, a reference voltage $V_{REF}$, applied at input port 106 of operational amplifier A1, sets the regulated voltage $V_{REG}$. The dual path linear voltage regulator tracks $V_{REF}$ and adjusts its output voltage $V_{REG}$ so that these two voltages match. The reference voltage $V_{REF}$ may be generated by any one of well-known circuits, such as for example by a band-gap reference circuit.

Input port 106 is the inverting, or negative, input port of operational amplifier A1. Output port 108 of operational amplifier A1 is connected to the gate of transistor Mn. In the embodiment of FIG. 1, transistor Mn is an nMOSFET (n-Metal Oxide Semiconductor Field Effect Transistor). The source of transistor Mn is grounded (connected to substrate 110). The drain of transistor Mn is connected to input port 112, which is the non-inverting, or positive, input port of operational amplifier A1. The drain of transistor Mn is also connected to node 102 and to decoupling capacitor 120.

Output port 108 is connected to input port 114, the non-inverting, or positive, input port of operational amplifier A2. Output port 116 is connected to the inverting, or negative, input port of operational amplifier A2. Operational amplifier A2 is configured as a unity-gain buffer so that the voltage at output port 116 follows that of output port 108. Output port 116 is also connected to the gate of transistor Mp. In the embodiment of FIG. 1, transistor Mp is a pMOSFET. The drain of transistor Mp is connected to node 102, and the source of Mp is connected to voltage rail 118. Transistor Mp may be referred to as a pass transistor. Capacitor 122 is used to insert a low bandwidth pole at the output of operational amplifier A1, and it also improves the PSR by enabling transistor Mp to better reject $V_{CC}$ noise.

With the drain of transistor Mp connected to positive input port 112, there is a first feedback loop comprising operational amplifier A1, operational amplifier A2, and transistor Mp. With the drain of transistor Mn connected to positive input port 112, there is a second feedback loop comprising operational amplifier A1 and transistor Mn. This is the motivation for referring to an embodiment represented by FIG. 1 as a dual path linear voltage regulator.

In operation, if the voltage at node 102, $V_{REG}$, were to increase above its desired regulated value, $V_{REF}$, then the output voltage at output port 108 would increase. Because operational amplifier A2 is configured as a unity-gain buffer, the voltage at output port 116 would also increase, reducing the magnitude of the gate-to-source voltage of pass transistor Mp, causing pass transistor Mp to source less current to load 104, and thereby counteracting an increase in voltage at node 102. In addition, when the voltage at output port 108 increases, there is an increase in the gate-to-source voltage of transistor Mn. As a result, transistor Mn shunts current from node 102 to ground, further counteracting an increase in voltage at node 102. Accordingly, transistor Mn may be referred to as a shunt transistor.

For some embodiments, the operating bandwidth of the second feedback loop may be designed to be larger than that of the first feedback loop. For such embodiments, operational amplifier A2 lowers the magnitude of the gate-to-source voltage of transistor Mp slower than the rate that operational amplifier A1 increases the gate-to-source voltage of transistor Mn.

If the voltage $V_{REG}$ at node 102 were to decrease below $V_{REF}$, then the output voltage at output port 108 would decrease, thereby increasing the magnitude of the gate-to-source voltage of pass transistor Mp, causing pass transistor Mp to source more current to load 104, thereby counteracting a decrease in voltage at node 102. In addition, a decrease in voltage at output port 108 below $V_{REG}$ decreases the gate-to-source voltage of shunt transistor Mn, causing shunt transistor Mn not to shunt current to ground. If for some embodiments the operating bandwidth of the second feedback loop is larger than that of the first feedback loop, then amplifier A2 would increase the gate-to-source voltage of transistor Mp slower than the rate that amplifier A1 would decrease the magnitude of the gate-to-source voltage of transistor Mn.

Transistor Mn shunts current from node 102 to ground when its gate-to-source voltage exceeds its threshold voltage. Although the shunting function provided by transistor Mn may degrade efficiency, the relatively fast response of the second feedback loop provided by amplifier A1 in conjunction with transistor Mn allows for the use of a smaller output de-coupling capacitor than might be needed if the second feedback loop were not present. Letting $Z_{REG}$ denote the small-signal impedance of the dual path linear voltage regulator as seen by voltage rail 118, $Z_{REG}$ is expected to have a phase not below −90 degrees. As a result, it is expected that output de-coupling capacitor 120 need not be as large as what might be needed if the second feedback loop were not present, and embodiments need not be over-damped in order for the phase of $Z_{REG}$ not to fall below −90 degrees. $Z_{REG}$ may be referred to as the regulator impedance.

Figure 3:
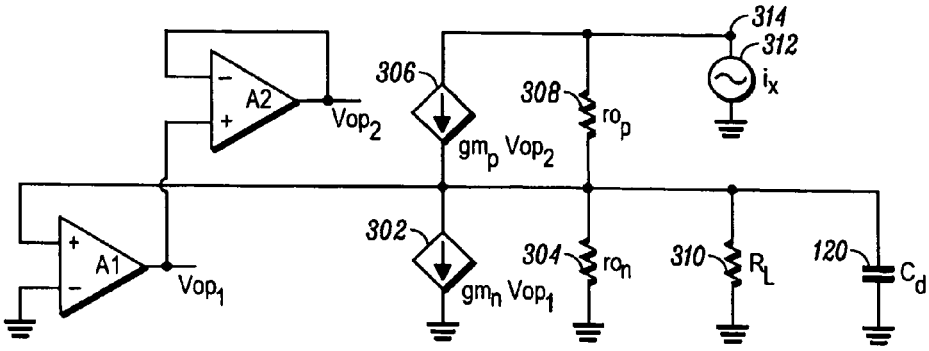
FIG. 3 is the small-signal circuit model for the embodiment of FIG. 1.

An expression for the regulator impedance as seen by voltage rail 118 may be derived from a small-signal circuit model for FIG. 1, which is shown in FIG. 3. In FIG. 3, the small-signal model for transistor Mn is represented by voltage-controlled current source 302 and small-signal resistor 304, where $gm_n$ is the small-signal transconductance of transistor Mn. The small-signal model for transistor Mp is represented by voltage-controlled current source 306 and small-signal resistor 308, where $gm_p$ is the small-signal transconductance of transistor Mp. The small-signal impedance for load 104 is represented by impedance 310. Small-signal current source 312 is introduced to calculate the regulator impedance $Z_{REG}$, where if $v_x$ is the small-signal voltage at node 314 and $i_x$ is the current provided by current source 312, then $Z_{REG}=v_x/i_x$.

With the variables shown in FIG. 3 representing the various corresponding small-signal currents and impedances as indicated in FIG. 3, an expression for $Z_{REG}$ may be derived, which is given below.

$$Z_{REG} = \frac{\left(1+\frac{s}{\omega_{lbw}}+Ao_{lbw}\right)\left(gm_n r_{op} R_x Ao_{hbw} + \left(1+\frac{s}{\omega_x}\right)\left(1+\frac{s}{\omega_{hbw}}\right) ro_p + R_x\left(1+\frac{s}{\omega_l}\right)\right) + gm_p r_{op} R_x Ao_{hbw} Ao_{lbw}}{\left(1+\frac{s}{\omega_{lbw}}+Ao_{lbw}\right)\left(gm_n r_{op} R_x Ao_{hbw} + \left(1+\frac{s}{\omega_x}\right)\left(1+\frac{s}{\omega_{hbw}}\right)\right)(gm_p r_{op}+1)}$$

The variables $R_x$ and $\omega_x$ in the above expression are defined as:

$$R_x = R_L \| ro_n,$$

and $$\omega_x = \frac{ro_n + R_L}{ro_n R_L C_d}.$$

In the above-displayed expression, $Ao_{hbw}$ is the open loop DC gain of operational amplifier A1, $Ao_{lbw}$ is the open loop DC gain of operational amplifier A2, $\omega_{lbw}$ is the open loop bandwidth of operational amplifier A2, and $\omega_{hbw}$ is the open loop bandwidth of operational amplifier A1.

Figure 4:
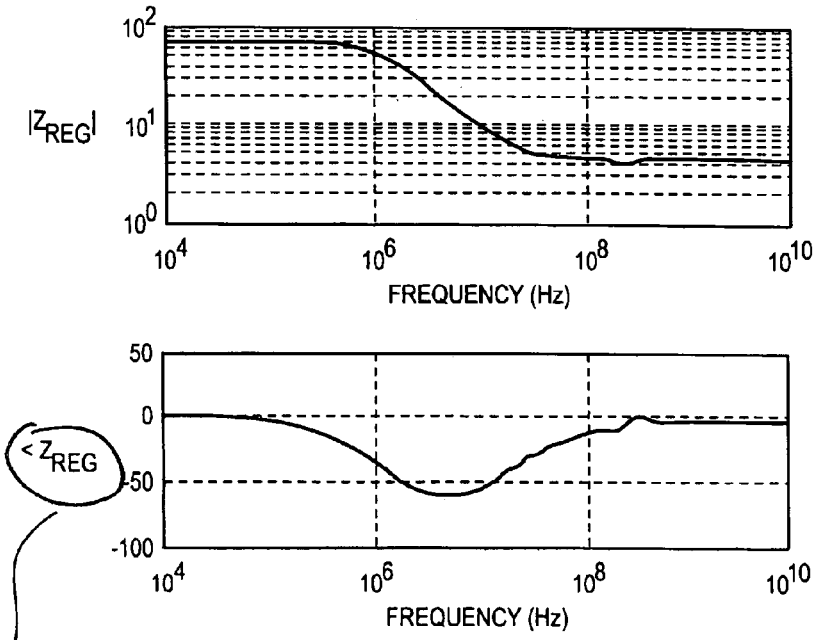
FIG. 4 illustrates plots of the magnitude and phase of the small-signal impedance for the model of FIG. 3.

FIG. 4 shows plots of the magnitude and phase of $Z_{REG}$ for typical values substituted for the variables in the above-displayed expression for $Z_{REG}$. As seen from the plots, the phase angle for $Z_{REG}$ does not fall below −90 degrees.

Figure 5:
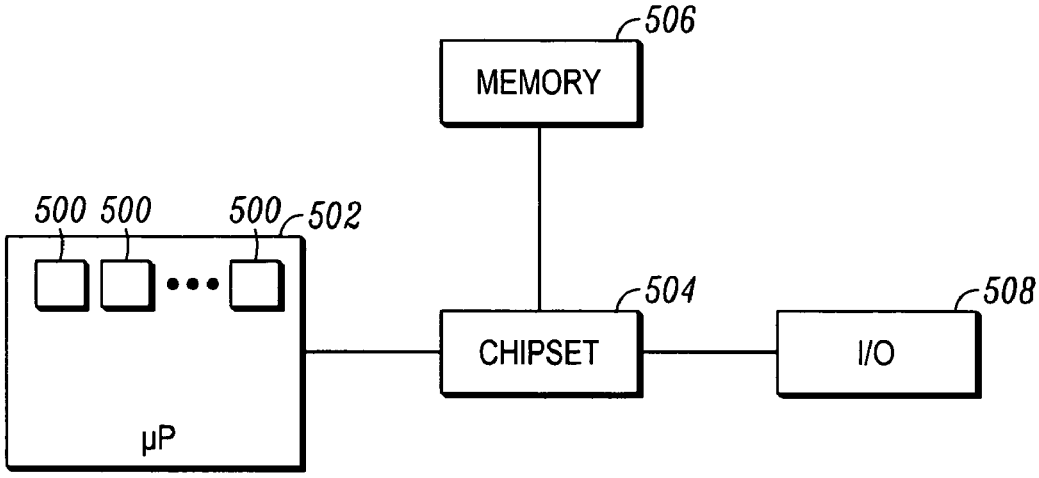
FIG. 5 illustrates a portion of a computer system utilizing embodiments of the present invention.

Embodiments of the present invention are expected to find wide applications. One such application is to regulate the voltage provided to one or more circuits in one or more microprocessor execution cores by utilizing one or more dual path linear voltage regulators. FIG. 5 illustrates such an application, where a simplified, high-level diagram of a portion of a typical computer system is illustrated. In FIG. 5, microprocessor 502 communicates with chipset 504, where chipset 504 provides communication to system memory 506 and other I/O components, represented by block 508. Chipset 504 may comprise one or more distinct die, and memory 506 may represent a hierarchy of memory. Embodiments of the present invention may find application in microprocessor 502, indicated as blocks 500, as well as in other system components in FIG. 5. Applications of embodiments of the present invention are not limited to computer systems.

Various modifications may be made to the disclosed embodiments without departing from the scope of the invention as claimed below.

It is to be understood in these letters patent that the meaning of "A is connected to B", where A or B may be, for example, a node or device terminal, is that A and B are connected to each other so that the voltage potentials of A and B are substantially equal to each other. For example, A and B may be connected together by an interconnect (transmission line). In integrated circuit technology, the interconnect may be exceedingly short, comparable to the device dimension itself. For example, the gates of two transistors may be connected together by polysilicon, or copper interconnect, where the length of the polysilicon, or copper interconnect, is comparable to the gate lengths. As another example, A and B may be connected to each other by a switch, such as a transmission gate, so that their respective voltage potentials are substantially equal to each other when the switch is ON.

It is also to be understood in these letters patent that the meaning of "A is coupled to B" is that either A and B are connected to each other as described above, or that, although A and B may not be connected to each other as described above, there is nevertheless a device or circuit that is connected to both A and B. This device or circuit may include active or passive circuit elements, where the passive circuit elements may be distributed or lumped-parameter in nature. For example, A may be connected to a circuit element that in turn is connected to B.

It is also to be understood in these letters patent that various circuit blocks, such as current mirrors, amplifiers, etc., may include switches so as to be switched in or out of a larger circuit, and yet such circuit blocks may still be considered connected to the larger circuit because the various switches may be considered as included in the circuit block.

What is claimed is:

1. A circuit comprising:

a node having a voltage;

a first feedback loop to regulate the node voltage, comprising a pass transistor to source a current to the node, the pass transistor having a gate, the first feedback loop comprising a unity gain buffer having an output port connected to the gate of the pass transistor and having an input port; and a second feedback loop to regulate the node voltage, comprising a shunt transistor having a gate-to-source voltage and a threshold voltage, the shunt transistor to shunt a portion of the current when the gate-to-source voltage exceeds the threshold voltage, the shunt transistor having a gate connected to the input port of the unity gain buffer.

2. The circuit as set forth in claim 1, wherein the pass transistor is a pMOSFET and the shunt transistor is a nMOSFET.

3. The circuit as set forth in claim 1, the second feedback loop further comprising a first operational amplifier having a positive input port coupled to the node and an output port coupled to the gate of the shunt transistor.

4. The circuit as set forth in claim 1, wherein the first feedback loop has a first operating bandwidth and the second feedback loop has a second operating bandwidth larger than the first operating bandwidth.

5. The circuit as set forth in claim 3, the pass transistor comprising a gate, the first feedback loop further comprising a second operational amplifier having a positive input port coupled to the output port of the first operational amplifier, a negative input port, and an output port coupled to the negative input port of the second operational amplifier and coupled to the gate of the pass transistor.

6. The circuit as set forth in claim 3, wherein the first feedback loop has a first operating bandwidth and the second feedback loop has a second operating bandwidth larger than the first operating bandwidth.

7. A circuit comprising:

a node;

a pass transistor comprising a gate and a drain connected to the node;

a buffer comprising an input port and an output port connected to the gate of the pass transistor;

a shunt transistor comprising a gate and a drain connected to the node; and a first operational amplifier comprising an output port connected to the gate of the shunt transistor and to the input port of the buffer, and a positive input port connected to the drain of the shunt transistor.

8. The circuit as set forth in claim 7, wherein the pass transistor is a pMOSFET and the shunt transistor is a nMOSFET.

9. The circuit as set forth in claim 7, the buffer comprising a second operational amplifier comprising an output port connected to the gate of the pass transistor, a negative input port connected to the output port of the second operational amplifier, and a positive input port connected to the output port of the first operational amplifier.

10. The circuit as set forth in claim 7, the pass transistor, the buffer, and the second operational amplifier forming a first feedback loop having a first operating bandwidth; and the shunt transistor and the first operational amplifier forming a second feedback loop having a second operating bandwidth greater than the first operating bandwidth.

11. The circuit as set forth in claim 10, the buffer comprising a second operational amplifier comprising an output port connected to the gate of the pass transistor, a negative input port connected to the output port of the second operational amplifier, and a positive input port connected to the output port of the first operational amplifier.

12. A computer system comprising:

a memory; and a processor in communication with the memory, the processor comprising a voltage regulator, the voltage regulator comprising;

a node having a voltage;

a first feedback loop to regulate the node voltage, comprising a pass transistor to source a current to the node, the pass transistor having a gate, the first feedback loop comprising a unity gain buffer having an output port connected to the gate of the pass transistor and having an input port; and a second feedback loop to regulate the node voltage, comprising a shunt transistor having a gate-to-source voltage and a threshold voltage, the shunt transistor to shunt a portion of the current when the gate-to-source voltage exceeds the threshold voltage, the shunt transistor having a gate connected to the input port of the unity gain buffer.

13. The computer system as set forth in claim 12, wherein the pass transistor is a pMOSFET and the shunt transistor is a nMOSFET.

14. The computer system as set forth in claim 12, the second feedback loop further comprising a first operational amplifier having a positive input port coupled to the node and an output port coupled to the gate of the shunt transistor.

15. The computer system as set forth in claim 12, wherein the first feedback loop has a first operating bandwidth and the second feedback loop has a second operating bandwidth larger than the first operating bandwidth.

16. The computer system as set forth in claim 14, the pass transistor comprising a gate, the first feedback loop further comprising a second operational amplifier having a positive input port coupled to the output port of the first operational amplifier, a negative input port, and an output port coupled to the negative input port of the second operational amplifier and coupled to the gate of the pass transistor.

17. The computer system as set forth in claim 14, wherein the first feedback loop has a first operating bandwidth and the second feedback loop has a second operating bandwidth larger than the first operating bandwidth.

* * * * *